United States Patent [19]

McMurphy

[11] Patent Number: 5,055,185

[45] Date of Patent: Oct. 8, 1991

[54] ANTI-FREEZE SEPARATOR ASSEMBLY

[76] Inventor: Luther M. McMurphy, 200 S. Parkway, Liberal, Kans. 67901

[21] Appl. No.: 541,027

[22] Filed: Jun. 20, 1990

[51] Int. Cl.[5] ..... B01F 3/12

[52] U.S. Cl. ..... 210/123; 210/97; 210/128; 210/129; 210/198; 210/206; 210/207; 166/75.1; 137/59; 137/60; 137/61; 137/62; 222/185; 222/207; 405/130; 405/131; 405/217; 422/32; 422/40; 422/41; 422/43

[58] Field of Search ..... 210/97, 123, 126, 128, 210/129, 206, 207; 166/67, 75.1, 105, 267, 901; 405/130, 131, 217; 422/32, 33, 34, 35, 36, 37, 40, 41, 43; 137/59, 60, 61, 62, 301; 222/185, 207

[56] References Cited

U.S. PATENT DOCUMENTS

| | | | |
|---|---|---|---|
| 355,005 | 12/1886 | Deutsch | 210/289 |
| 1,698,890 | 1/1929 | McGill | 210/206 |
| 3,035,701 | 5/1962 | May | 210/123 |
| 3,261,403 | 7/1966 | Newman | 166/67 |
| 3,772,193 | 11/1973 | Nelli et al. | 210/205 |
| 3,899,425 | 8/1975 | Lewis | 210/206 |
| 3,966,608 | 6/1976 | Mason et al. | 210/205 |
| 4,355,652 | 10/1982 | Perkins | 137/59 |
| 4,476,928 | 10/1984 | Green | 166/75.1 |
| 4,694,900 | 9/1987 | Behrens | 166/75.1 |
| 4,759,907 | 7/1988 | Kawolics et al. | 422/7 |

*Primary Examiner*—Robert A. Dawson

*Assistant Examiner*—David Reifsnyder

*Attorney, Agent, or Firm*—Phillip A. Rein

[57] ABSTRACT

This invention relates to an anti-freeze separator assembly connected to a piece of equipment in outdoor freezing conditions in order to take a fluid, such as water, and treat same for subsequent disposal without freezing. The anti-freeze separator assembly includes 1) a main container housing; 2) a material retainer member mounted within the main container housing to receive and hold a treatment chemical therein; 3) an enclosure cap assembly releasably mounted on the main container housing; 4) a main fluid inlet assembly connected to the main container housing to transfer a fluid to be treated therein; and 5) a main discharge assembly connected to the main container housing to transfer a treat fluid therefrom. The main discharge assembly includes a discharge pipe member connected to a transfer pipe assembly with a diaphragm valve assembly therebetween. The diaphragm valve assembly is operable periodically to open and permit treated fluid within the main container housing to be discharged into a fluid storage tank. The anti-freeze separator assembly is operable to 1) periodically receive fluid therein for a predetermined time period; 2) treatment of the fluid by a chemical material to achieve a condition to prevent freezing of the liquid; and 3) periodically transfer the treated fluid to a storage tank and replace same with non-treated inlet fluid for subsequent treatment.

14 Claims, 3 Drawing Sheets

ANTI-FREEZE SEPARATOR ASSEMBLY

PRIOR ART

A patent search on this invention revealed the following United States Patents:

| U.S. Pat. No. | Invention | Inventor |
|---|---|---|
| 355,005 | FILTER | William M. Deutsch |
| 1,698,890 | CHEMICAL FILTER AND BASE EXCHANGE SOFTENER | Chester T. McGill |
| 3,261,403 | ANTI-FREEZE SIPHON FOR OVER THE TOP PUMP DELIVERY | J. C. Newman |
| 3,772,193 | DEVICE AND METHOD FOR INTRODUCING A CHEMICAL INTO A LIQUID | Nelli et al |
| 3,899,425 | MODULAR FILTER AND AUTOMATIC CHLORINATOR FOR SWIMMING POOLS | Kenneth Lewis |
| 3,966,608 | LIQUID TREATMENT APPARATUS | Mason et al |
| 4,476,928 | METHOD AND APPARATUS FOR SOLVENT GENERATION AND RECOVERY OF HYDROCARBONS | William G. Green |
| 4,694,900 | DRY PELLET DISPENSING DEVICE FOR WELLS | Kelly D. Behrens |
| 4,759,907 | FEEDER DEVICE AND METHOD FOR ADDING SOLID MATERIAL TO A LIQUID OF VARIABLE FLOW RATE | Kawolics et al |

The Deutsch patent discloses a filter structure having a sand filter medium with an inlet, outlet, and continuous fluid flow plus provided with an upper container to maintain a chemical therein.

The McGill patent discloses a chemical filter and softener structure which is a basic water softener structure operating with a continuous water flow to soften water.

The Newman patent discloses an anti-freeze structure which lowers the water level below a frost line.

The Nelli et al patent discloses a swimming pool chlorinator structure having a chemical maintained in a central enclosure. This permits the inlet water to come into contact with the chemical for dissolving thereof but inlet fluid can flow about the chemical directly to an outlet channel.

The Lewis patent discloses an automatic chlorinator for swimming pools and having a stand pipe with a cap thereon.

The Mason et al patent discloses a liquid treatment apparatus whereupon the fluid is forced downwardly for recirculation and aeration but fluid therein can flow directly from inlet to outlet.

The Green patent discloses an apparatus used in combination with an oil well which is separating liquid vapors therefrom. There is an air inlet structure for aerating the fluid which aids in creating the vapors which are then separated therefrom through the use of a condenser structure.

The Behrens patent discloses a chemical dispensing device used in combination with a well structure. However, in this device, a chemical such as chlorine pellets are dispensed according to a timer structure into the water well and, therefore, does not operate similar to your invention.

The Kawolics et al patent discloses a method for adding a chemical within a fluid flow structure.

PREFERRED EMBODIMENT OF THE INVENTION

In one preferred embodiment of this invention, an anti-freeze separator assembly is provided usable with an oil, gas, and water separator apparatus in order to receive, treat, and discharge a fluid such as water therefrom in a manner so as to prevent freezing thereof under winter operating conditions. The oil, gas, water separator apparatus is of a conventional nature and normally utilized in conjunction with oil and gas wells whereupon the oil and/or gas is separated from a fluid such as water in a normal processing operation on receiving same from a well. This invention can also be utilized in any system such as a gas compressor system whereupon a fluid, such as water, is produced as a by-product and exposure to outside winter weather conditions is a factor necessary for the continued operation thereof. The anti-freeze separator assembly includes 1) a main container housing; 2) a material retainer member mounted within the main container housing; 3) an enclosure cap assembly mounted on an upper open end of the main container housing; 4) a main fluid inlet assembly connected to the oil, gas, and water separator apparatus to transfer fluid, such as water, into the main container housing; and 5) a main discharge assembly connected to the main container housing and operable to transfer treated fluid therefrom outwardly to a fluid storage tank. The main container housing is of a generally propane tank shape having the material retainer member mounted therewithin being a cylindrical wall structure to separate a fluid treatment chemical such as a softener salt from other portions thereof. The enclosure cap assembly is provided with a main enclosure cap member threadably engagable and releasably connectable to an upper connector neck section of the main container housing. The main enclosure cap member is connected to a bleed-off valve assembly having an on/off valve member which can be utilized to relieve pressure from the main container housing before removing the main enclosure cap member for repair and servicing operations. The main fluid inlet assembly is provided with a separator inlet pipe member connected to an upright discharge pipe member positioned centrally and extended longitudinally of the main container housing. The upright discharge pipe member is provided with a plurality of spaced discharge hole members at a lower portion thereof to allow an inlet fluid to flow therefrom and having external cap threads on an upper end thereof. The main fluid inlet assembly further includes an enclosure cap member mounted on the top external threads of the upright discharge pipe member. The enclosure cap member can be readily removed for dropping treatment chemical pellets into the upright discharge pipe member. The material retainer member is provided with a plurality of longitudinal upright slots therein operable to allow a fluid to flow therethrough but acting to retain the treatment chemcial pellets within the confines of the cylindrical retainer housing. The main discharge assembly includes a discharge pipe member which is connected through a diaphragm valve assembly and a transfer pipe assembly for conveyance to a fluid storage tank or other disposal means such as for irrigation purposes, watering of cattle, or the like depending on weather conditions. The diaphragm valve assembly includes a pressure diaphragm member operably connected to a float valve assembly on the oil, gas, and water separator apparatus. On an opening of the diaphragm valve assembly, a fluid level within the oil, gas, and water separator apparatus is automatically lowered to force fluid within the main separator housing through the main fluid inlet assembly which, then, forces the fluid previously contained in the main container housing upwardly and outwardly through the main discharge assembly to the fluid storage tank. Use of the treatment chemical material, such as softener salt, which has been placed within the main container housing operates to create a salt water solution which will not freeze except under extremely cold conditions. The new fluid within the main container housing, after being treated by the softener salt pellets, will move outwardly through the discharge pipe member and transfer pipe assembly for storage within the fluid storage tank without freezing occuring.

OBJECTS OF THE INVENTION

One object of this invention is to provide an anti-freeze separator assembly to be used with and connected to an oil, gas, and water separator apparatus normally used in oil and gas field drilling operations and operable to take a by-product, such as a fluid which is susceptible to freezing under winter conditions, and treat subject fluid so as to be non-freezable under normal weather conditions for subsequent discharge therefrom to a storage tank or the like.

Another object of this invention is to provide an anti-freeze separator assembly which can be used to 1) be connected to a piece of equipment such as a high pressure gas compressor or an oil, gas, and water separator apparatus operable to receive a freezable fluid therewithin; 2) treat the freezable fluid to become a substantially non-freezable solution; 3) discharge the treated fluid therefrom to a storage tank or disposal area; and 4) continuously recycle the fluid treatment system in periodic increments.

One other object of this invention is to provide an anti-freeze separator assembly operable to 1) receive a fluid in a main container housing from a main fluid inlet assembly; 2) treat the subject inlet fluid within the main container housing through contact with a treatment chemical material for a pre-determined period of time; and 3) periodically discharge the treated fluid from the main container housing outwardly through a main discharge assembly and replace the treated fluid with untreated fluid from the main fluid inlet assembly.

One further object of this invention is to provide an anti-freeze separator assembly having a main container housing with an enclosure cap assembly mounted thereon whereupon the enclosure cap assembly can be removed to deposit a treated chemical material into a material retainer member and into a main fluid inlet assembly so as to provide means for treating a fluid within the main fluid inlet assembly and the main container housing before subsequent discharge therefrom through a main discharge assembly.

Additionally, one other object of this invention is to provide an anti-freeze separator assembly of compact size which can be utilized with any piece of equipment having a problem in a winter condition operation of creating a liquid fluid, such as water, which is subject to freezing conditions which would cease equipment operation and being operable 1) to treat subject fluid into a non-freezing fluid; and 2) periodically dispense the non-freezing fluid and replace with a freezable fluid for treatment thereof.

Still, one other object of this invention is to provide an anti-freeze separator assembly of compact size and weight which is economical to manufacture; automatic in operation; easy to repair and maintain; and reliable in operation.

Various other objects, advantages, and features of the invention will become apparent to those skilled in the art from the following discussion, taken in conjunction with the accompanying drawings, in which:

FIGURES OF THE INVENTION

Figure 1:
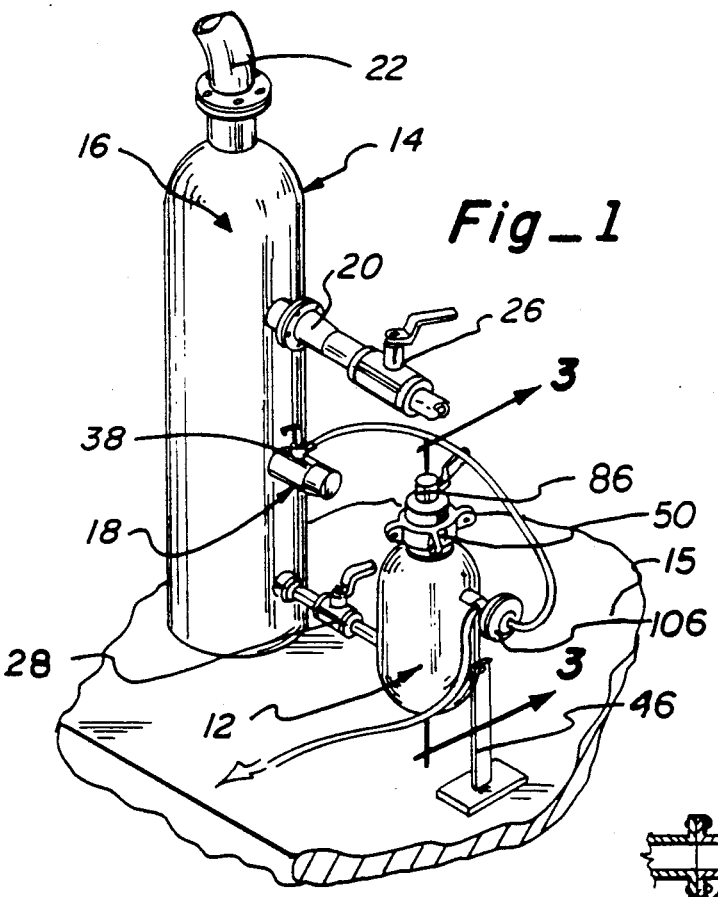
FIG. 1 is a perspective view of an anti-freeze separator assembly of this invention as operably connected to an oil, gas, and water separator apparatus, all supported on a concrete pad.

The following is a discussion and description of preferred specific embodiments of the antt-freeze separator assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, an anti-freeze separator assembly of this invention, indicated generally at 12, is usable with any piece of equipment which produces a freezable type by-product (such as water) and the illustrated equipment is an oil, gas, and water separator apparatus 14 supported on a concrete pad 15. The oil, gas, and water separator apparatus 14 is of a conventional nature utilized in well drilling and production operations in an oil field and being operable to receive the mixture of oil and/or gas plus water from a well structure (not shown) whereupon a freezable fluid, such as water, is a by-product produced therefrom. This anti-freeze separator assembly 12 relates to a system for receiving the fluid by-product, such as water, and treating same to achieve a non-freezing condition for ease of handling and subsequent discharge to a storage tank as will be explained.

The oil, gas, and water separator apparatus 14 includes a main separator housing 16 having a float valve assembly or fluid sensor means 18 mounted thereon. The main separator housing 16 includes 1) a main fluid inlet line 20 operable to transfer a gas and water mixture thereto; 2) a gas outlet line 22 to transfer a gas product therefrom for further processing; and 3) a water discharge line 24 connected to a lower portion of the main separator housing 16 to transfer the fluid by-product or water therefrom for subsequent processing.

The main fluid inlet line 20 is provided with an on/off valve member 26 to cut off an inlet flow of oil and fluid for repair, and service purposes.

The water discharge line 24 is provided with an on/-off valve member 28 which can be used to shut off the flow to the anti-freeze separator assembly 12 for repair and servicing.

Figure 2:
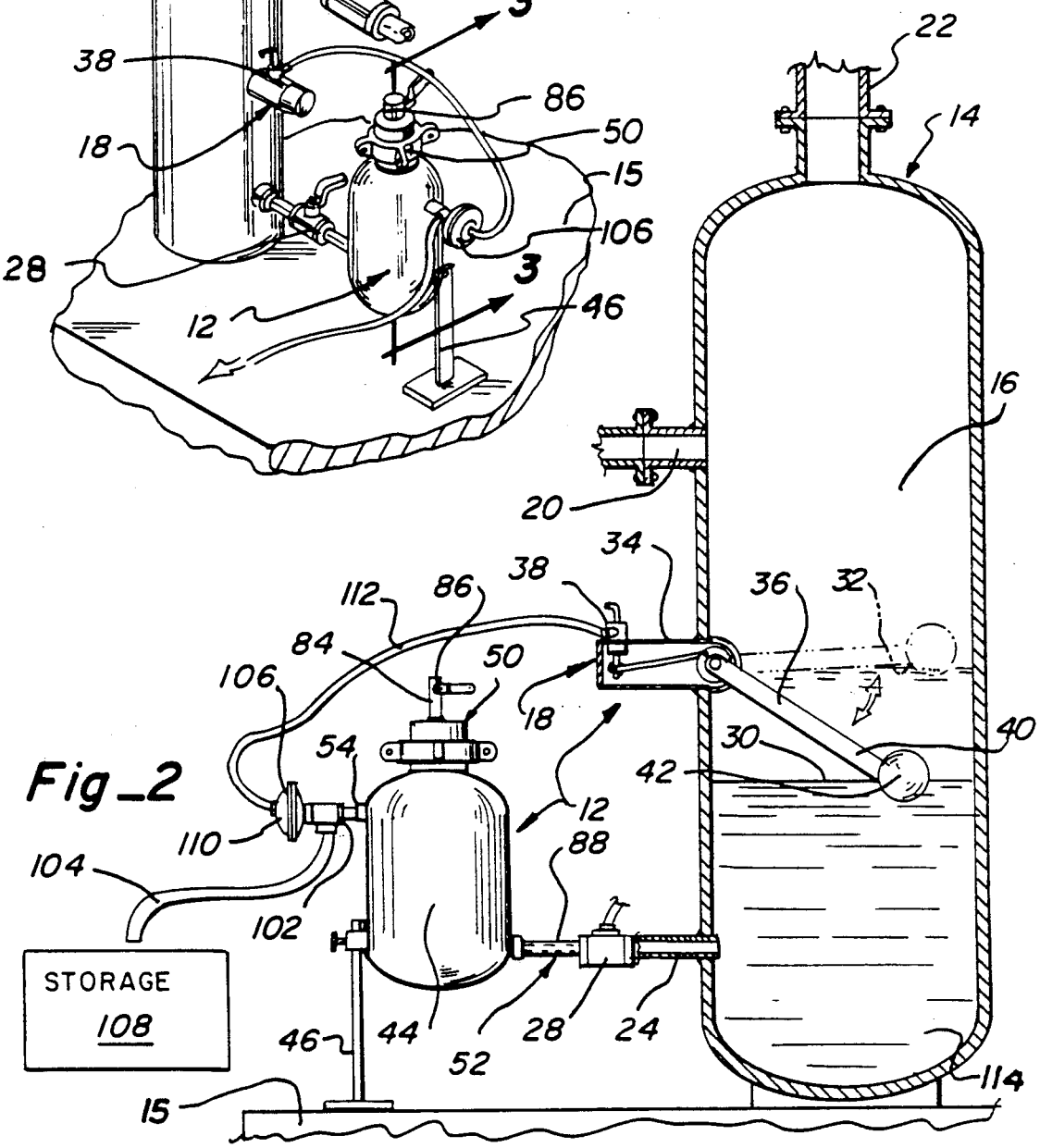
FIG. 2 is an elevational view of the anti-freeze separator assembly of this invention as connected to the oil, gas, and water separator apparatus and having a sectional view of a main separator housing to illustrate operation thereof.

As noted in the main separator housing 16 as shown in FIG. 2, there are basically two levels of fluid being a lower fluid level 30 and an upper actuator water level 32. On reaching the actuator water level 32, the float valve assembly 18 is operated in a manner to be described in order to lower the fluid level to a level indicated by the water level 30.

The float valve assembly 18 includes a float actuator assembly 34 operably connected to a float valve member 36. The float actuator assembly 34 includes an exhaust valve member 38 which is operable in one condition to bleed air pressure and lower the fluid level in the main separator housing 16 as will be explained.

The float valve member 36 is of a conventional nature including a rod member 40 operably connected to the exhaust valve member 38 and having a ball member 42 mounted on an outer end thereof. The float valve member 36 is operable in a conventional manner so, when reaching an uppermost actuator water level 32 as shown in dotted line in FIG. 2, it operates to open the exhaust valve member 38 of the float actuator assembly 34 to initiate a fluid transfer operation as will be explained.

The anti-freeze separator assembly 12 includes 1) a main container housing or means 44 which resembles in shape and size a charcoal cooking propane bottle structure; 2) a material retainer member 48 mounted within the main container housing 44; 3) an enclosure cap assembly 50 mounted about an entrance area into the main container housing 44; 4) a main fluid inlet assembly or means 52 connected to the main container housing 44 operable to transfer fluid to be treated from the main separator housing 16 of the oil, gas, and water separator apparatus 14; and 5) a main discharge assembly or means 54 operably connected to the main container housing 44 and operable to transfer the treated fluid therein outwardly and laterally for further processing as will be noted.

The main container housing 44 includes 1) an arcuate bottom wall 56; 2) a cylindrical side wall 58 integral with the arcuate bottom wall 56; and 3) an arcuate top wall 60 integral with the upper edge of the cylindrical side wall 58 to achieve a conventional propane tank shape.

The arcuate top wall 60 is provided with an upper entrance opening 62 and a connector neck section 64 having external thread members 66 thereon for receiving the enclosure cap assembly 50 thereon as will be noted.

The material retainer member 48 is of a generally cylindrical shape having a cylindrical retainer housing 68 provided with a plurality of spaced fluid discharge slots 70 therewithin to allow fluid to flow therethrough but retaining the treatment chemical.

Figure 3:
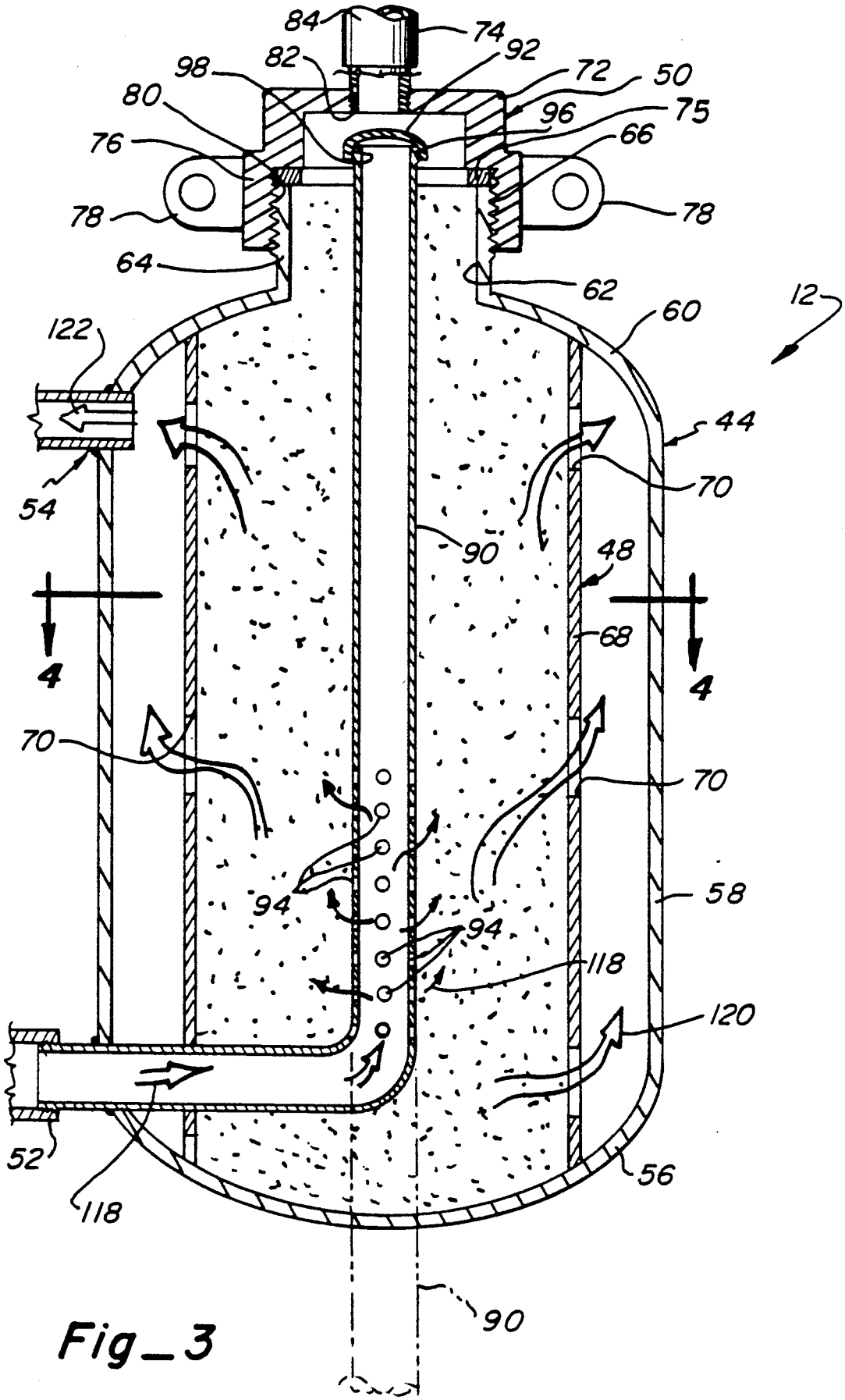
FIG. 3 is an enlarged fragmentary sectional view taken along line 3—3 in FIG. 1.
Figure 4:
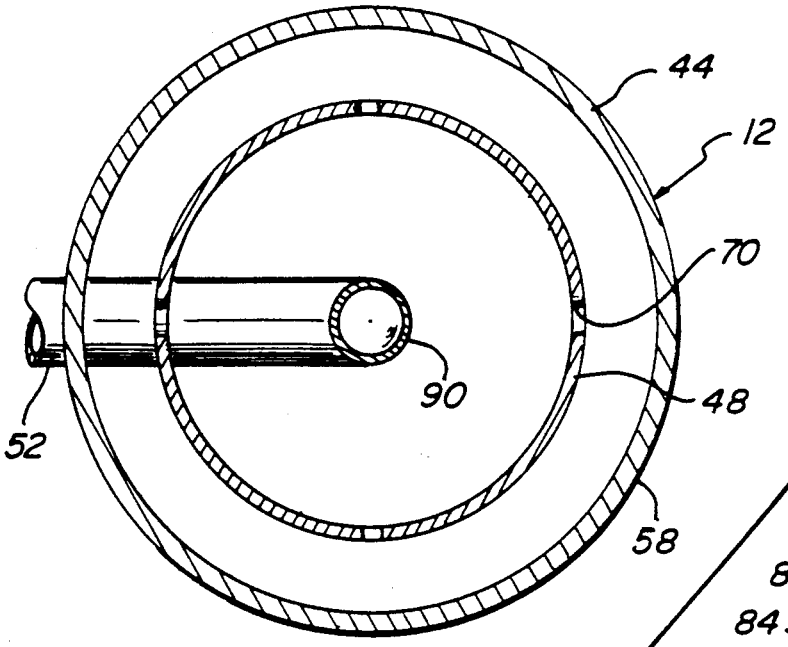
FIG. 4 is a sectional view taken along line 4—4 in FIG. 3 without any fluid or treatment chemical therein.

The cylindrical retainer housing 68 is welded about its upper and lower ends abutting portions of the inner surface of the main container housing 44 as noted in FIG. 3. Therefore, this provides an inner container section to receive the treatment chemical therein and hold within a central area for treatment of the inlet fluid as will be explained.

The enclosure cap assembly 50 includes 1) a main enclosure cap member 72; 2) a bleed-off valve assembly 74 connected to the main enclosure cap member 72; and 3) a gasket member 75 mounted between the main enclosure cap member 72 and the connector neck section 64 of the main container housing 44 to provide a sealing function therebetween.

The main enclosure cap member 72 includes a cap housing 76 having laterally extended lug members 78 connected thereto. The lug members 78 operate to provide a means for tapping with a hammer or the like to tighten or loosen subject connection of the main enclosure cap member 72 on the external thread members 66 of the main container housing 44.

The cap housing 76 is provided with internal threads 80 in a central cavity and an upper discharge opening 82 which is connected to the bleed-off valve assembly 74. The external threads 80 are adapted to mate with the external thread members 66 on the main container housing 44 in a conventional manner for interconnecting plus clamping the gasket member 75 therebetween in a known sealing operation.

The bleed-off valve assembly 74 is provided with a connector pipe 84 mounted within the discharge opening 82 and operably connected to an on/off valve member 86. The on/off valve member 86 is operable when necessary to relieve pressure within the main container housing 44 for providing maintenance and service operations.

The main fluid inlet assembly 52 includes 1) a separator inlet pipe member 88 which is operable to receive inlet fluid therewithin through the on/off valve member 28 and the water discharge line 24 from the main separator housing 16; 2) an upright discharge pipe member 90 connected to separator inlet pipe member 88; and 3) an enclosure cap member 92 mounted on an upper end of the upright discharge pipe member 90 for access thereto.

The upright discharge pipe member 90 includes a plurality of discharge hole members 94 in a lower one-third portion thereof and external cap threads 96 on a top portion thereon.

The enclosure cap member 92 includes internal cap threads 98 which are operble to be releasably engagable and sealed with the external cap threads 96 to permit the enclosure cap member 92 to be removed for adding a treatment chemical thereto in a manner to be explained.

It is noted that the main fluid inlet assembly 52 is illustrated in FIG. 3 as mounted on the same side as the main discharge assembly 54 but it is obvious that the separator inlet pipe member 88 can be extended in any direction from the main container housing 44 and can be extended vertically directly through the bottom wall 56 as noted in dotted lines in FIG. 3 and will still receive the same end result on operation thereof.

The main discharge assembly 54 includes 1) a discharge pipe member 102 connected to and extended through the main container housing 44; 2) a transfer pipe member 104 connected to the discharge pipe member 102 to transfer fluid flow therefrom; 3) a diaphragm valve assembly or control means 106 mounted at the junction of the discharge pipe member 102 and transfer pipe assembly 104 to control fluid flow therethrough; and 4) a fluid storage tank 108 operably connected to the transfer pipe assembly 104 to receive the treated fluid therefrom on a manner to be explained.

The diaphragm valve assembly 106 is of a conventional pressure actuated type having a pressure diaphragm member 110 therein connected through a pressure release line 112 to the float valve assembly 18. The float valve assembly 18 is periodically operable as will be noted to release fluid pressure within the pressure release line 112 which, in turn, would then open the diaphragm valve assembly 106. This allows fluid flow under gravity or pressure through the main fluid inlet assembly 52 outwardly through the discharge pipe member 102 and transfer pipe assembly 104 for discharge into the fluid storage tank 108.

USE AND OPERATION OF THE INVENTION

In the use and operation of the invention as noted in FIG. 1, it is noted that anti-freeze separator assembly 12 is initially connected to a piece of equipment creating a freezable fluid, such as water, from a high pressure gas compressor or, as illustrated in this embodiment, an oil, gas, and water separator appparatus 14. The oil, gas, and water separator apparatus 14 is operable to receive a mixture such as oil and/or gas and fluid (normally water) through the main fluid inlet line 20 for separation and discharge of the separated gas through the gas outlet line 22 for further processing. During this initial stage of operation, the fluid, such as water, indicated at 114 in FIG. 2, is created therein and must be treated to prevent freezing and periodically removed to keep the oil well processing method and operation in continuing operation.

The fluid 114 created in the operation of the oil, gas, and water separator apparatus 14 needs to be periodically removed therefrom on reaching an upper predetermined actuator water level 32 as noted in dotted lines in FIG. 2. On reaching this level, the float valve assembly 18 operates to open the exhaust valve member 38 which releases air pressure in the pressure release line 112. This release of air pressure opens the diaphragm valve assembly 106 and bleeds air pressure therefrom through pressure release line 112 where it is discharged into the atmosphere.

On opening of the diaphragm valve assembly 106, this permits the actuator water level 32 within the main separator housing 16 to move downwardly towards the lower water level 30 on passage of subject fluid into the main container housing 44. The pressure within the main separator housing 16 during the normal gas/oil/-water separation processing would then act on a top surface of the actuator water level 32 to force the fluid therewithin through the main fluid inlet assembly 52 into the main container housing 44.

This would then force the fluid through the discharge hole members 94 and the upright discharge pipe member 90 to move outwardly and upwardly as indicated by the arrows 118 in FIG. 3. Thereupon, the fluid during a summer time operation which will not need to be treated as to be described under freezing conditions, moves outwardly through the open diaphragm valve assembly 106 and the transfer pipe assembly 104 into the fluid storage tank 108. However, in the summer operation, the non-treated fluid or water 114 can instead be transferred to a cattle watering tank or used for irrigational purposes.

The main purpose and function of the anti-freeze separator assembly 12 of this invention is to permit its operation during winter freezing conditions in order to treat the fluid 114 created in the oil, gas, and water separator apparatus 14 so that it can be periodically transferred through the transfer pipe assembly 104 into the fluid storage tank 108 without freezing thereof.

Therefore, on proceeding with a winter operation type situation, the in/off valves 26, 28 leading to the oil, gas and water separator apparatus 14 are placed in the "off" condition to cease processing within the anti-freeze separator assembly 12. At this same time, the bleed-off valve assembly 74 and, more particularly, the on/off valve member 86 of the enclosure cap assembly 50 is placed in the open condition to relieve any pressure within the main container housing 44.

Figure 5:
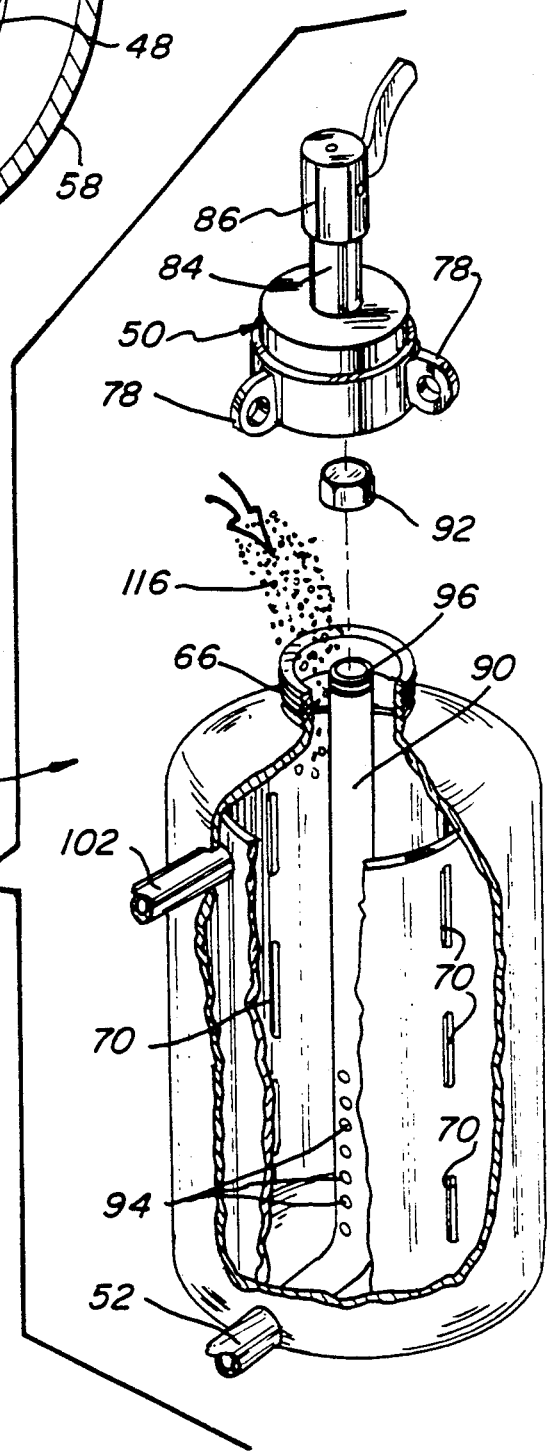
FIG. 5 is a perspective view of a main container housing of the anti-freeze separator assembly of this invention illustrating portions broken away for clarity and an enclosure cap assembly illustrated in exploded perspective.

After release of any pressure, the main enclosure cap member 72 is rotated to the open condition which may be aided by use of a hammer structure against the lug members 78. Once removed, the operator can thereupon add treatment chemical pellets 116 as noted in FIG. 5 through the entrance opening 62 of the main container housing 44. The treatment chemical 116 in this case may be a water softener treatment salt which is added to fill up the cavity between the cylindrical retainer housing 68 of the material retainer member 48 and an inner surface of the main container housing 44 as noted in FIG. 3.

At this time, the enclosure cap member 92 mounted on the upright discharge pipe member 90 is removed whereupon the treatment chemical 116 is inserted in the discharge pipe member 90. This acts to create a treated solution within the upright discharge pipe member 90 plus outwardly and laterally to the water discharge line 24 of the main separator housing 16 of the oil, gas, and water separator apparatus 14. This assures that any fluid contained within the water discharge line 24, the on/off valve member 28, and the separator inlet pipe member 88 is receiving a salt water solution to prevent freezing of the fluid 114 thereon as it moves from the oil, gas, and water separator apparatus 14 to the anti-freeze separator assembly 12.

Next, the enclosure cap member 92 and the main enclosure cap member 72 are remounted to assume the conditions of FIG. 3 and the on/off valve member 86 is placed in an "off" or closed condition. At this time, the on/off valve members 26, 28 are moved to the opened condition to initiate the oil well processing method.

On initiating this winter condition operation, it is noted that the oil, gas, and water separator apparatus 14 continues to operate to separate gas which is expelled through the gas outlet line 22 and to create the fluid 114 which settles to the bottom of the main separator housing 16 as noted in FIG. 2. When the fluid 114 therein reaches an actuator water level 32, the float valve assembly 18 operates through the float valve member 36 to open the exhaust valve member 38 of the float actuator assembly 34. This, then, opens the pressure release line 112 connected to the pressure diaphragm member 110 for exhaust to the atmosphere through the exhaust valve member 38.

Prior to this time, there has been a fluid 114 within the main container housing 44 which has been in contact with the treatment chemical 116 to achieve a salt water solution. At this time, the salt water solution is present within the main fluid inlet assembly 52 from the oil, gas, and water separator apparatus 14 to prevent freezing thereof.

On opening of the diaphragm valve assembly 106, the level of fluid 114 within the main separator housing 16 moves toward the water level 30 as the fluid 114 moves through the water discharge line 24 to the main container housing 44. The fluid 114 moves into the separator inlet pipe member 88 and the upright discharge pipe member 90 to discharge outwardly through the discharge hole members 94. This inlet fluid flow, indicated by the arrow 118 in FIG. 3, moves through the interior if the cylindrical retainer housing 68 and to displace the treated salt water therewithin.

At this time, the treated salt water moves upwardly and outwardly as noted by arrow 122 through the discharge pipe member 102; the open diaphragm valve assembly 106; the transfer pipe assembly 104 and into the fluid storage tank 108. The transfer pipe assembly 104 is in an open condition as has been previously subjected to the treated salt water and, therefore, the water will flow freely outwardly therefrom into the fluid storage tank 108.

After a pre-determined amount of fluid is dispensed from the main separator housing 16 which is a volume of water between the water level 30 and actuator water level 32 as noted in FIG. 2, this causes the float valve assembly 18 to close the exhaust valve member 38 to then cease the exhaust of air through the pressure release line 112. Thereupon, the pressure diaphragm member 110 is moved to the closed condition and fluid discharge through the transfer pipe assembly 104 is ceased. At this time, the newly arrived fluid 114 within the main container housing 44 is subjected to the treatment chemical material 116 to initiate creation of a salt water solution.

Although it is known that a salt water solution may be subject to freezing under extreme low temperatures, it has been found that use of the salt water pellets being the treatment chemical material 116 is operable under normal operations to prevent freezing of the fluid 114 within the container housing 44; the main fluid inlet assembly 52; and the main discharge assembly 54. Also, due to the periodic movement of the fluid 114 from the oil, gas, and water separator apparatus 14 in the overall system, this fluid movement is known to agitate the water therein and assist in preventing freezing of the treated fluid even under low outdoor temperature conditions.

The fluid initially transferred from the oil, gas, and water separator apparatus 14 to the anti-freeze separator assembly 12 is in a heated condition as separation of the oil, gas, and water within the main separator housing 16 is achieved from a high temperature processing. Thereupon, the fluid 114 as it moves from the main separator housing 16 is in a heated condition of 65–70 degrees Fahrenheit which achieves better dissolving of the treatment chemical material 116 within the main container housing 44 to achieve the salt water solution.

The addition of the treatment chemical material 116 within the separator inlet pipe member 88 and upright discharge pipe member 90 is desirable as maintains the salt water solution therewithin so that no freezing occurs between the main container housing 44 and the main separator housing 16.

It has been noted that freezing in the oil, gas, and water separator apparatus 14 under winter conditions has been a very serious problem in oil field operations. Without the anti-freeze separator assembly 12 of this invention, it has been found that the fluid 114, being condensed water, when periodically transferred from the main separator housing 16 though the transfer pipe assembly 104 towards the fluid storage tank 108 would freeze. The chance of freezing during fluid transfer to the storage tank 108 is increased as dump lines on the transfer pipe assembly 104 might be from 50 to 90 feet in length. If nothing else, a gradual ice built-up in the dump lines would be formed, especially with the flow of fluid 114 under gravity until finally the transfer pipe assembly 104 becomes clogged with ice.

This frozen ice would back-up the processing system whereupon the fluid 114 would rise above the actuator water level 32 and eventually plug-in the main fluid inlet line 20 and cease operation of the entire oil, gas, and water separator apparatus 14 and the oil well processing operation.

In the past, upon freezing up of the oil, gas, and water separator apparatus 14, it was necessary to hire oil well servicing personnel in order to provide for the breakout and unfreezing of the tranfer pipe assembly 104 and draining in order to continue operation. This would cost the oil well operator and owner approximately $180.00 to $200.00 per day for labor in order to place the oil well back into operation. Additionally, there is considerable time and money lost in oil and gas well production and the down time may be from 12 to 24 hours depending on when the frozen defective operation has been noted.

The anti-freeze separator assembly 12 of this invention has been tested and operated effectively for temperatures as low as minus 10–12 degrees and for a period of at least one week, no down time of the oil wells were experienced, and the transfer pipe assembly 104 did not reach a frozen condition.

An additional novelty of the anti-freeze separator assembly 12 is that it works extremely well on oil and gas wells producing three barrels of water per day or less but could be increased in size and capacity so that it would satisfactorily operate with larger production of water.

The float valve assembly 18 can be set so that the volume of fluid 114 between the water level 30 and actuator water level 32 is equal to the volume of fluid 114 within the main container housing 44 to be displaced in each sequence of fluid dispensing operation.

It has also been found that the volume of fluid 114 to be discharged from the main separator housing 16 can be greater than the volume of fluid 114 in the main container housing 44 without experiencing any freezing in the tranfer pipe assembly 104 or the fluid storage tank 108.

The anti-freeze separator assembly 12 of this invention can be utilized with any piece of equipment which produces a by-product that would freeze such as water from the normal operation. For example, a high pressure gas compressor unit utilized in oil field operations can have the anti-freeze separator assembly 12 connected thereto and operable to automatically and periodically receive a fluid such as water which is normally produced in an gas compression operation. The fluid from the gas compression operation would thereupon be treated into a salt water solution and periodically dumped therefrom to keep the high pressure gas compressor equipment in continuous operation. Therefore, the anti-freeze separator assembly 12 can be utilized on numerous types of operations other than oil, gas, and water separator systems.

The anti-freeze separator assembly of this invention is economical to manufacture; sturdy in construction; simple in operation; and substantially maintenance free.

While the invention has been described in conjunction with preferred specific embodiments thereof, it will be understood this description is intended to illustrate and not to limit the scope of the invention, which is defined by the following claims:

I claim:

1. An anti-freeze separator assembly connected to processing equipment to receive and treat a fluid therefrom tp prevent freezing thereof comprising:

a) a main container housing;

b) a material retainer member mounted within said main container housing operable to receive and retain a treatment chemical therein;

c) a fluid inlet assembly connected to a fluid inlet source and extended within said main container housing said inlet source connected to an upright discharge pipe member to convey fluid directly into said material retainer member the fluid being treated therein by the treatment chemical said upright discharge pipe member being mounted in an enclosed by said material retainer member;

d) a main discharge assembly including a discharge pipe member connected to said main container housing to convey the fluid therefrom after treatment in said material retainer member; and e) a main enclosure cap assembly mounted on an inlet opening into said material retainer member having an enclosure cap mounted on said inlet opening.

whereby said fluid is transferred from the fluid inlet source into said material retainer member into contact with the treatment chemical to form a freeze resistant fluid solution, and the fluid solution is subsequently transferred laterally of said material retainer member for discharge through said main discharge assemble.

2. An anti-freeze separator assembly as described in claim 1, wherein:

a) said upright discharge pipe member provided with a plurality of discharge openings therewithin extending in a lower portion thereof so as to convey the inlet fluid into a lower portion of said material retainer member to be acted on by the treatment chemical therein for subsequent lateral movement through said material retainer member and discharge through said discharge pipe member in said main discharge assembly.

3. An anti-freeze separator assembly as described in claim 2, wherein:

a) said fluid inlet assembly includes an enclosure cap member mounted on an upper portion of said upright discharge pipe member so as to direct fluid and contain treatment chemical placed therewithin so as to assure dispensing of the inlet fluid at a lower portion through said discharge openings for contact with the treatment chemical before movement of the treated inlet fluid into said main container housing for subsequent discharge through said discharge pipe member and the treatment chemical prevents freezing within the entire length of said upright discharge pipe member including its interconnection to the fluid inlet source.

4. An anti-freeze separator assembly as described in claim 1, wherein:

a) said material retainer member having a plurality of spaced slots therein operable to permit transfer of the treated inlet fluid therethrough under inlet fluid pressure but retain the treatment chemical therewithin;

whereby the inlet fluid, only after treatment by the treatment chemical, is moved laterally, upwardly, and outwardly for discharge from said main discharge assembly.

5. An anti-freeze separator assembly as described in claim 1, including:

a) a bleed-off valve assembly mounted on said enclosure cap member; and b said bleed-off valve assembly having an on/off valve member operable to selectively be opened to relieve pressure within said main container housing and access to said material retainer member for repair and servicing operations.

6. An anti-freeze separator assembly as described in claim 1, including:

a) said main discharge assembly including a control means mounted on said discharge pipe member and operable to be periodically selectively actuated from closed to open conditions in order to remove fluid after treatment under gravity fluid flow conditions from said main container housing laterally for discharge therefrom to a fluid storage tank.

7. An anti-freeze separator assembly as described in claim 6, including:

a) a fluid sensor means mounted between the fluid inlet source and said control means to selectively open said control means to discharge fluid into said upright discharge pipe member and displace the treated fluid in said material retainer member and being operable on sensing a presence of a high fluid level in the fluid inlet source.

8. An anti-freeze separator assembly connected to oil, gas and water separator apparatus in order to receive a freezable fluid therefrom for processing and subsequent discharge comprising:

a) a main container means having a material retainer member operable to receive and retain a treatment chemical therein;

b) a fluid inlet means connected to said main container means to convey the freezable fluid for discharge directly and solely into said material retainer member;

c) a fluid discharge means including a discharge pipe member connected to said main container means and a control means mounted on said discharge pipe member to selectively open and close said discharge pipe member for discharge of a treated fluid from said main container means; and d) a fluid sensor means mounted between the fluid inlet source and said control means said control means operable to sense an actuator fluid level and open said control means to transfer the treated fluid from said main container means through said fluid discharge means and automatically and concurrently replace with untreated, freezable fluid to said material retainer member in said main container means.

9. An anti-freeze separator assembly as described in claim 8, wherein:

a) said material retainer member operable to create a separate containment compartment within said main container means and having discharge openings therewithin to discharge the fluid therefrom after treatment by the treatment chemical into an area surrounding said material retainer member in said main container means to said fluid discharge means.

10. An anti-freeze separator assembly as described in claim 8, including:

a) said fluid inlet means includes an upright discharge pipe member having an enclosure cap member releasably connected to an upper end thereof; and b) an enclosure cap assembly mounted on said main container means operable to be removed therefrom to add the treatment chemical into said material retainer member and said discharge pipe member on removal of said enclosure cap member to contact the inlet fluid and transfer same into a non-freezing chemical solution.

11. An anti-freeze separator assembly as described in claim 8, wherein:

a) said fluid sensor means including a float valve assembly, operable on reaching an actuator fluid level to actuate said control means for a pre-determined time period so as to add the freezable fluid directly through an upright discharge pipe member in said material retainer member to discharge the treated fluid within said main container means outwardly through said fluid discharge means; and b) said fluid sensor means being operable on reaching a lower water level to close said control means to prevent additional discharge from said main container means until the untreated fluid therein is treated by the treatment chemical to achieve a non-freeze solution.

12. An anti-freeze separator assembly as described in claim 8, wherein:

a) said fluid inlet means includes an upright discharge pipe member extended inwardly and centrally of said material retainer member and said main container means and provided with discharge holes at a lower portion thereof for fluid movement through the treatment chemical before discharge at an upper area of said main container means through said discharge pipe member.

13. An anti-freeze separator assembly as described in claim 1, wherein:

a) said material retainer member secured between a bottom wall and a top wall of said main container housing to form an enclosed inner container section to receive and contain the treatment chemical therein; and b) inlet fluid is directed into said upright discharge pipe member, flows into said enclosed inner container, flows outwardly into a space between said material container member and said main container housing, and discharged through said discharge pipe member.

14. An anti-freeze separator assembly as described in claim 8, wherein:

a) said material retainer member secured between a bottom wall and a top wall of said main container means to form an enclosed inner container section to receive and contain the treatment chemical therein; and b) inlet fluid is directed solely into said material retainer member, flows into said enclosed inner container, flows outwardly into a space between said material retainer member and said main container means, and discharged through said discharge pipe member.

* * * * *